United States Patent [19]

Williams et al.

[11] 4,239,099

[45] Dec. 16, 1980

[54] AUTOMATIC FORWARD-FEED SHELF

[75] Inventors: John L. Williams, Atlanta; Asa V. Brown, Jr., Royston, both of Ga.

[73] Assignee: The Mead Corporation, Atlanta, Ga.

[21] Appl. No.: 26,957

[22] Filed: Apr. 4, 1979

[51] Int. Cl.[3] ..... A47F 5/00; B65G 11/00

[52] U.S. Cl. ..... 193/32; 193/40; 211/49 D

[58] Field of Search ..... 193/32, 35 R, 35 A, 193/40, 2 D; 221/253, 279; 312/45, 91, 97, 134; 211/49 R, 49 D, 121, 122, 151; 188/84; 198/857

[56] References Cited

U.S. PATENT DOCUMENTS

| | | | |
|---|---|---|---|
| 1,495,402 | 5/1924 | Daniel | 193/35 X |
| 1,562,680 | 11/1925 | Bohn | 193/4 D |
| 2,234,424 | 3/1941 | Alley | 312/45 |
| 2,735,578 | 2/1956 | Woodroff | 221/11 |
| 2,806,631 | 9/1957 | Van Vactor | 221/13 |
| 3,279,618 | 10/1966 | Bergstedt | 211/49 R X |
| 3,458,023 | 7/1969 | Kramer et al. | 193/35 |
| 3,610,372 | 10/1971 | Warren | 193/35 X |
| 3,730,327 | 5/1973 | Lieberman | 198/857 |
| 4,128,177 | 12/1978 | Bustos | 193/2 D X |

*Primary Examiner*—Bruce H. Stoney, Jr.
*Assistant Examiner*—Gene A. Church
*Attorney, Agent, or Firm*—George A. Smith, Jr.

[57] ABSTRACT

In a gravity-feed shelf having an endless flexible conveyor belt supporting a plurality of articles arranged in a column and automatically feeding the articles in said column forward in a columnwise direction when the foremost article in the column is removed, one or more frictional pads are located at a position underneath said conveyor belt and are responsive to the presence of an article on said belt and above said position, for stopping the movement of said belt.

6 Claims, 10 Drawing Figures

AUTOMATIC FORWARD-FEED SHELF

CROSS-REFERENCE TO RELATED APPLICATION

This application discloses subject matter claimed in the copending application of John L. Williams entitled "Automatic Forward-Feed Shelf" and filed simultaneously herewith under Ser. No. 026,956, filed Apr. 4, 1979 The entire disclosure of said copending application is incorporated herein by reference.

BRIEF SUMMARY OF THE INVENTION

This invention relates to automatic, forward-feed shelving having particular utility in the merchandising of bottled soft drinks and similar products, wherein articles are arranged on a shelf in columns extending rearwardly from the front edge of the shelf, and are automatically carried forward toward the front edge when the foremost bottle in a column is removed by a customer. The invention relates particularly to improvements in the means used for stopping the forward movement of the column of articles.

Various forward-feed shelves have been proposed for use in the merchandising display of bottled soft drinks. One such proposal involves the provision of a shelf in which bottles arranged in a column on an inclined track slide forward toward the front edge of a shelf when the foremost bottle is removed. One problem with the use of an inclined track arises because of the differences in weights and frictional characteristics of soft drink bottles. Soft drinks are marketed in both glass and blow-molded plastic bottles, and the bottles are available in different sizes, for example one and two liter sizes. Because of these differences between bottles, problems have been encountered in the use of simple inclined tracks for gravity feed. If a glass bottle, which is generally heavier and more slippery than a plastic bottle of the same capacity, slides adequately on a given track, a plastic bottle may not slide at all on the same track. Conversely, if a plastic bottle is made to slide on that particular track by the use of an appropriately steep angle of inclination and an appropriate frictional characteristic on the supporting surface, a glass bottle may tend to slide too quickly on the same track, and may be damaged or even break when it reaches the front edge of the shelf at the lower end of the track.

One possible solution to the problems caused by differences between soft drink bottles on the market is exemplified by U.S. Pat. No. 4,128,177, which issued on Dec. 5, 1978 to Raphael T. Bustos. Bustos describes a display rack having an array of conveyor belts which are disposed at an angle relative to the horizontal, and which reduce the adverse effects of the different weights and frictional characteristics of the soft drink bottles. In the operation of the apparatus described by Bustos, as a bottle is removed from the forward end of a column of bottles, the conveyor belt conveys the remaining bottles toward the front of the shelf in response to gravity acting on said remaining bottles. The remaining bottles are stopped by contact of the bottle in back of the lead bottle with a bumper rail provided at the front edge of the shelf.

One difficulty with the use of a bumper rail to stop the movement of a column of bottles is that the bumper rail can cause damage to the labelling of the bottles, which is typically a foam plastic label in the case of glass bottles, or a paper label in the case of plastic bottles. Another problem arises if a rigid bumper rail is used, in that a rigid bumper rail tends to stop the foremost bottle in a column suddenly. Where a sudden stoppage occurs, the inertia of the bottles behind the foremost bottle may cause the bottles in the column to hit one another in backlash fashion, which may result in damage or breakage.

The principal object of this invention is to provide an automatic, forward-feed shelf in which the possible adverse effects of a bumper rail are eliminated. It is also an object of the invention to provide an automatic, forward-feed shelf in which the column of bottles or other articles is brought to a more gradual stop in order to reduce the likelihood of damage by reason of inertia.

The foregoing objects are accomplished in accordance with the invention in a shelf having a flexible conveyor belt by the provision of brake means in the form of one or more frictional pads located at a position underneath the conveyor belt and responsive to the presence of an article on the belt and above said position for stopping the movement of the belt. The pads frictionally engage the underside of the belt to retard its movement.

The brake means in accordance with the invention can be used not only with continuous conveyor gravity-feed shelving, but can also be used in connection with spring-actuated or motor-actuated conveyor systems. The manner in which the foregoing objects are accomplished, and various other objects of the invention, will be apparent from the following detailed description, when read in conjunction with the drawings.

DETAILED DESCRIPTION

Figure 1:
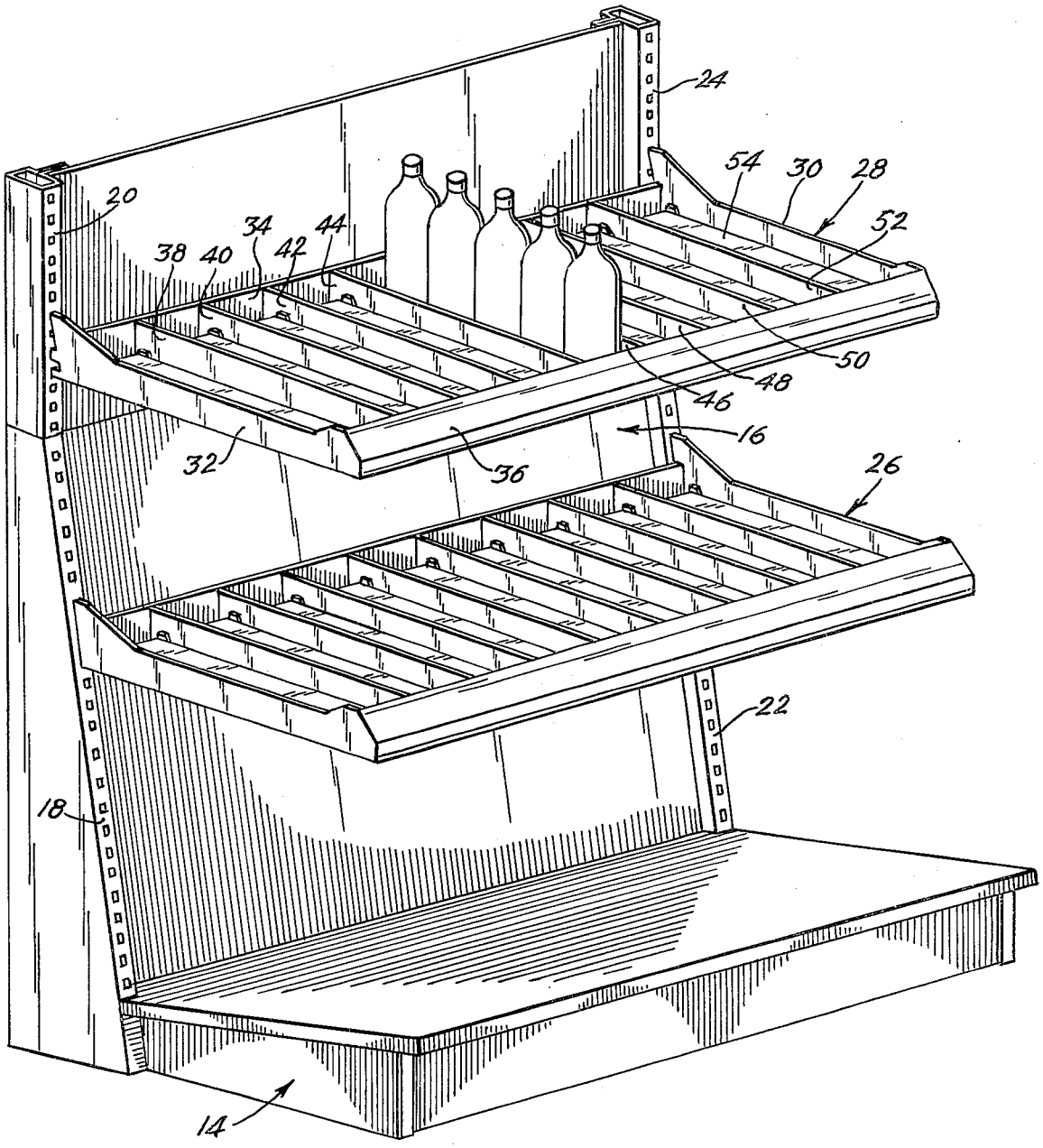
FIG. 1 is a perspective view of a soft drink display stand provided with forward-feed shelves in accordance with the invention, the shelves having removable conveyor tracks.

FIG. 1 shows a soft drink display rack comprising a base 14 and a back 16 extending upwardly from the base. Back 16 includes a left-hand upright shelf support member having a slotted sloping face 18, and a slotted vertical face 20. A similar slotted support is provided at the right-hand side of the back, and comprises a slotted sloping face 22, and a slotted vertical face 24. A first shelf 26 is supported in slots on sloping faces 18 and 22, and a second shelf 28 is supported in slots on the vertical faces 20 and 24 of the support members. The shelves are preferably identical to each other, and are supported in a substantially parallel relationship to each other on the respective sloping and vertical supports. The tabs on the shelves cooperate with the slots on the respective sloping and vertical faces in two different ways. Parallelism between the shelves is achieved by virtue of the relationship between the tab structure and the angle of the sloping faces of the support members. The manner in which this is accomplished is explained in detail in U.S. Pat. No. 3,983,822, dated Oct. 5, 1976, and the entire disclosure of that patent is incorporated herein by reference.

The shelves are formed from sheet metal. Each shelf, as exemplified by shelf 28 in FIG. 1, is generally in the form of a tray, bounded at the sides by shelf brackets 30 and 32, at the rear by a wall 34, and at the front by wall 36. Shelf 28 also has a series of eight equally spaced dividing walls 38–52, which are parallel to brackets 30 and 32, and which divide the space between these brackets into nine tracks extending from the rear wall 34 to front wall 36. The dividing walls act as guides for bottles on the shelf, and cause bottles placed on the shelf to be arranged in nine columns, each column preferably being able to contain at least five soft drink bottles. Five such bottles are shown between dividing walls 44 and 46.

Each track contains a removable gravity-feed conveyor such as conveyor 54 in the track between bracket 30 and divider 52. Each conveyor comprises a flexible belt, the upper surface of which is used to support the bottles. This upper surface is preferably, though not necessarily, substantially planar, and the shelf is disposed so that the front end of the belt is lower than the rear end of the belt. Desirably, the angle of inclination of the supporting surface of the belt is between about 7 degrees and 8.25 degrees from horizontal. This inclination provides for forward movement of the belt under the action of gravity acting on the bottles on the belt.

Figure 2:
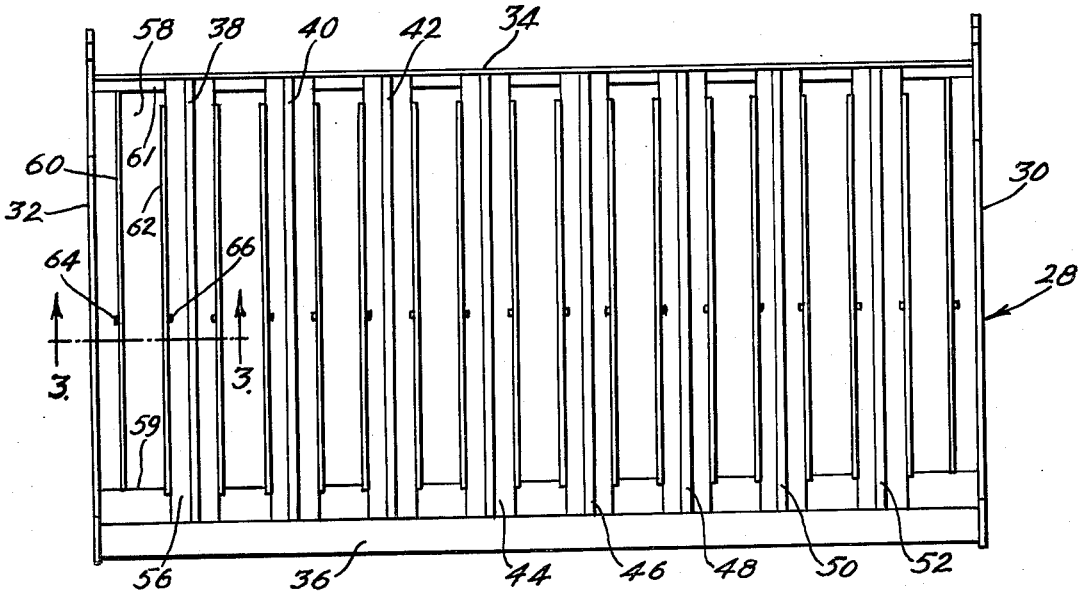
FIG. 2 is a top plan view of a shelf with the conveyor tracks removed.
Figure 3:
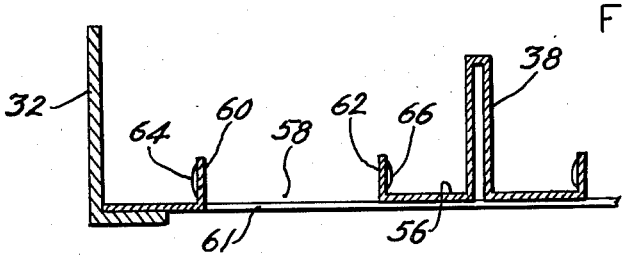
FIG. 3 is a vertical section taken on the plane 3—3 of FIG. 2.

FIG. 2 shows the floor 56 of shelf 28, the conveyor assemblies being removed. Floor 56 is interrupted by an elongated rectangular opening in each track, exemplified by opening 58 in the leftmost track, bounded by bracket 32 and divider 38. Opening 58 extends from a point 59 near the front of the track to a flange 61 at the bottom of the rear wall 34. The long edges of opening 58 are bounded by upwardly extending flanges 60 and 62, best seen in FIG. 3. The remaining openings in shelf floor 56 are provided with similar upstanding flanges.

The purpose of flanges 60 and 62 is to hold a removable conveyor assembly in the desired fixed position in the track. The flanges 60 and 62 themselves cooperate with depending side walls of the conveyor assembly to prevent left and right movement. The flanges are provided with struck-out projections 64 and 66, which cooperate with openings (not shown) provided in the depending side walls of the conveyor assembly to prevent forward and rearward movement of the assembly.

Figure 4:
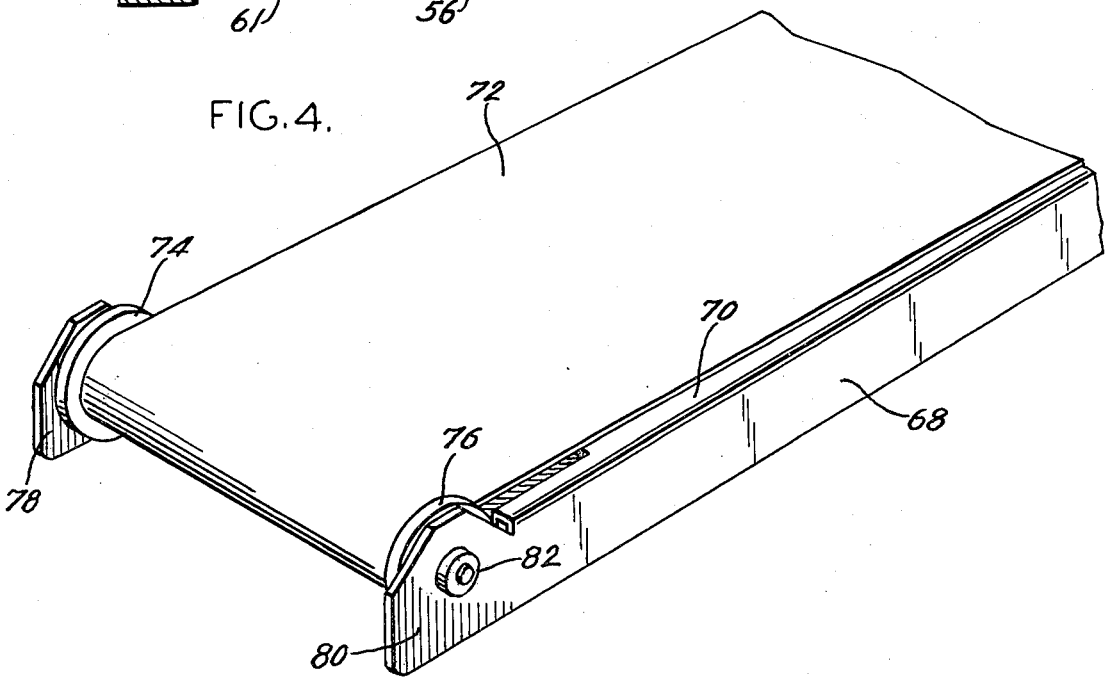
FIG. 4 is a fragmentary perspective showing the forward end of a preferred conveyor track, showing a flexible conveyor belt.

The conveyor assembly itself, as shown in FIG. 4, comprises a substantially rigid sheet metal support structure comprising depending side wall 68, a similar depending side wall (not shown) on the opposite side and parallel with side wall 68, the upper edges of the side walls being integrally connected together by a web 70, the upper surface of which provides support for an endless flexible conveyor belt 72. The belt is arranged in a loop, and web 70 is located within the loop so that the upper run of the belt slides on the upper surface of web 70, and the lower run passes underneath web 70 and between the depending side walls of the conveyor structure.

In the preferred form of the conveyor assembly, rollers are provided at both ends of the belt. The roller at the front end of the assembly shown in FIG. 4 comprises a pair of guide flanges 74 and 76, which are provided at opposite ends of the roller itself, which is obscured by the belt. The roller is rotatably supported in polytetrafluoroethylene (PTFE) bearings which are fixed in bearing supports 78 and 80, which are integral with the depending side walls of the conveyor support structure. One such bearing is indicated at 82 in bearing support 80. The structure at the opposite end of the conveyor assembly of FIG. 4 is substantially identical to the structure just described.

Figure 5:
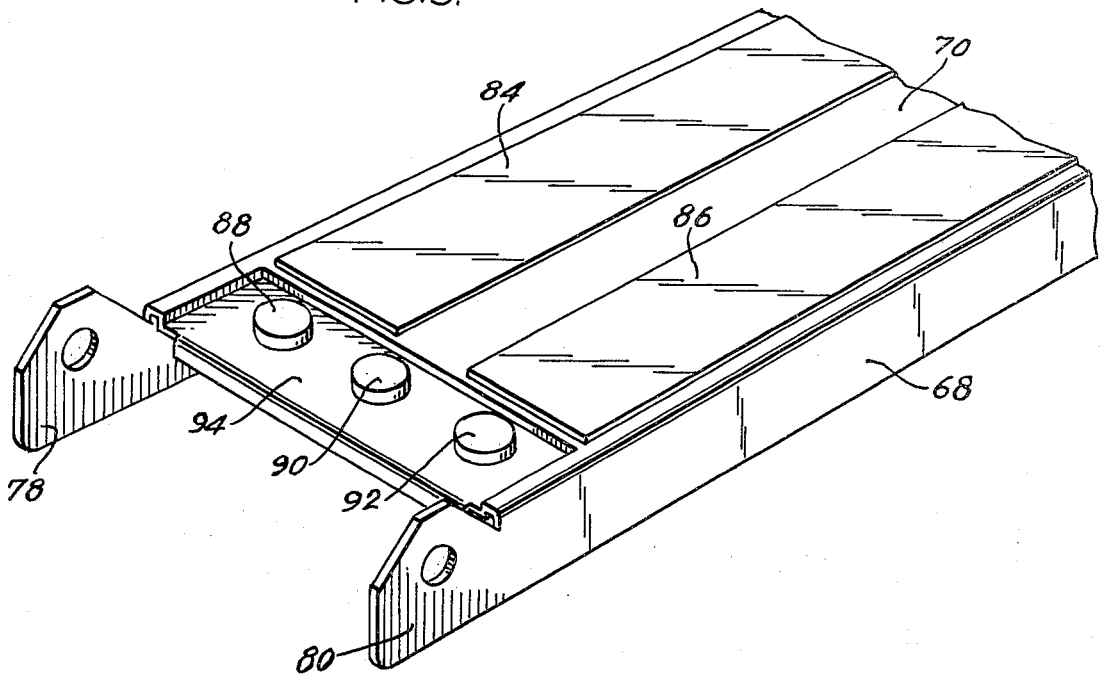
FIG. 5 is a fragmentary perspective of the conveyor track of FIG. 4, with the flexible belt removed, and showing an array of brake pads.

The conveyor belt 72 is preferably a polyester sheet material, e.g. poly(ethylene terephthalate). The upper surface of web 70, as shown in FIG. 5, is preferably provided with one or more longitudinally extending strips 84, 86 of PTFE or a similar low-friction material in order to allow the belt to slide smoothly over the support. It is desirable, though not necessary, to provide the outside of the belt loop with a somewhat rougher texture than the inside in order to prevent bottles from sliding with respect to the belt, while allowing the belt to slide smoothly on the support. It should also be noted at this point that the rollers are not absolutely necessary, and can be eliminated by providing instead a curved guide for the belt at the forward and rearward ends of the conveyor assembly, the curved guide being provided with PTFE or a similar material to promote smooth sliding of the belt around the belt guides.

The brake means for stopping the forward movement of the flexible conveyor belt is preferably constituted by one or more frictional pads, as indicated in FIG. 5 at 88, 90 and 92. Preferably, these pads are located in a recess 94 formed in web 70 near the front edge of the conveyor assembly. The pads are preferably rubber, and are held in place either by a suitable adhesive, or by virtue of the engagement of integral projections extending downwardly from the underside of the pad with holes provided in the surface of recess 94. As seen in FIG. 5, the upper surfaces of pads 88, 90 and 92 are substantially flat, and substantially flush with the surfaces of PTFE strips 84 and 86. The term "substantially flush" as used herein is intended to encompass minor variations from an exact flush relationship. In fact, for the best operation of the brake pads, it has been found desirable to position the flat surfaces of the pads about 0.3–0.4 mm. above the surfaces of the PTFE strips.

The three pads shown in FIG. 5 are aligned with each other in transverse direction. Of course, various other pad configurations and numbers of pads can be used, and examples of such other configurations are shown in FIGS. 7–10.

Figure 6:
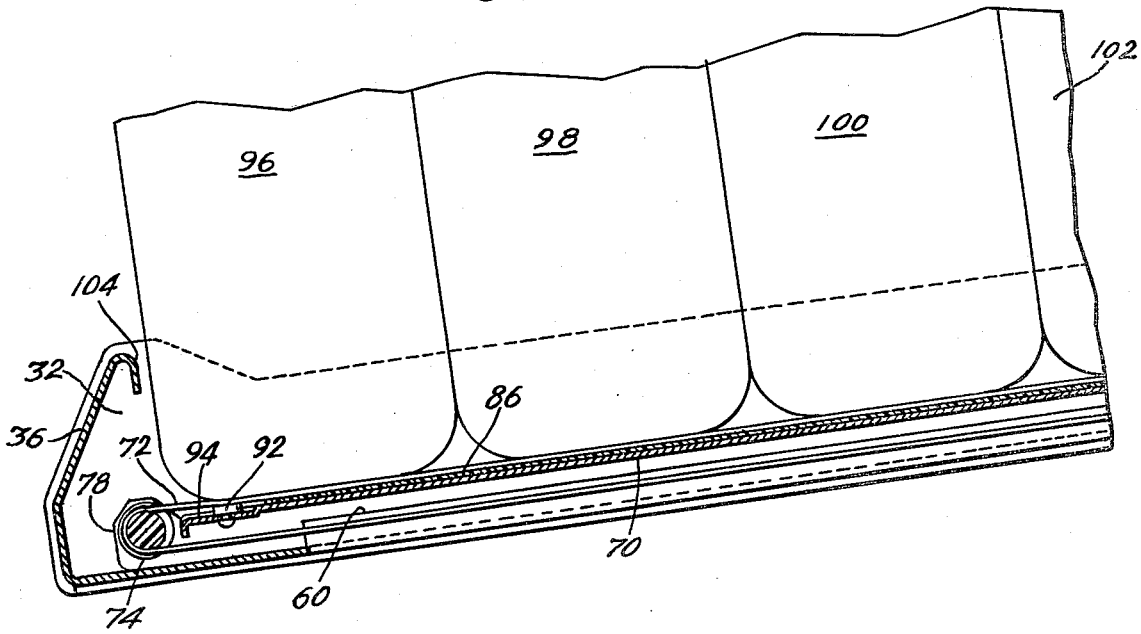
FIG. 6 is a longitudinal section through a conveyor track of the type illustrated in FIGS. 4 and 5, illustrating the operation of the brake pads.

FIG. 6 illustrates the operation of the belt brake mechanism of FIG. 5. Bottles 96, 98, 100 and 102 are arranged in a column in the track between bracket 32 and the adjacent divider (not shown) the bottles rest on flexible belt 72, and the weight of the foremost bottle 96 in the column presses belt 72 downwardly against the brake pads including pad 92. The friction between the pads and the underside of the belt prevents movement of the belt under the influence of gravity acting on the bottles in the column. It should be noted that bottle 96 is spaced from the rolled upper edge 104 of the overhanging front wall 36 by a short distance.

When bottle 96 is removed from the column, the pressure on the brake pads is relieved so that the belt is free to slide. Because of the inclination of the conveyor belt, the remaining bottles in the column move forward under the influence of gravity until bottle 98 is positioned over the brake pads, whereupon it exerts a downward pressure causing the brake pads to retard the movement of the belt. The belt stops when bottle 98 reaches approximately the same position in which bottle 96 is shown in the drawing. Preferably, the brake pads are positioned so that the foremost bottle stops at a distance of about 9 mm. from edge 104 of front wall 36. By bringing the foremost bottle to a point near the front wall, a measure of protection is provided against possible forward tipping of a bottle by reason of its inertia when it is stopped by the action of the brake means on the conveyor belt. Such forward tipping could occur, for example, in the event of misuse of the conveyor shelf by placing a single bottle at the top of the conveyor and allowing it to move forward under gravity through the entire length of the conveyor. In normal use of the conveyor, the fact that the conveyor belt is brought to a gradual stop by the brake means reduces the tendency of the bottles to tip forward.

Figure 7:
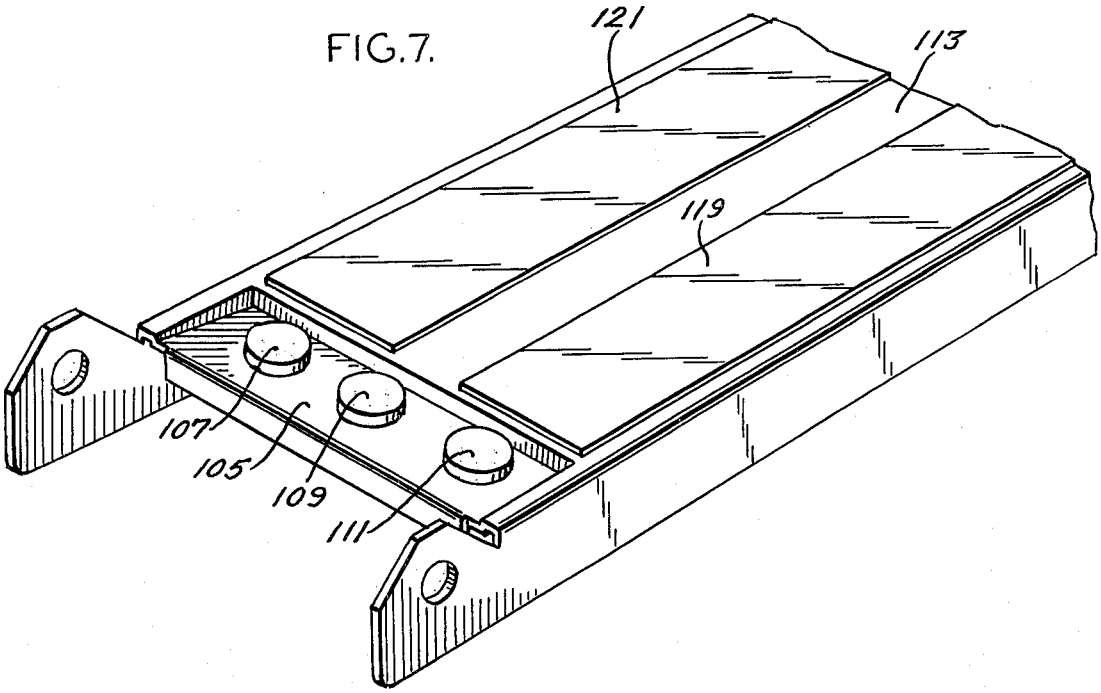
FIG. 7 is a fragmentary perspective showing the forward end of a track in accordance with a second embodiment of the invention.
Figure 8:
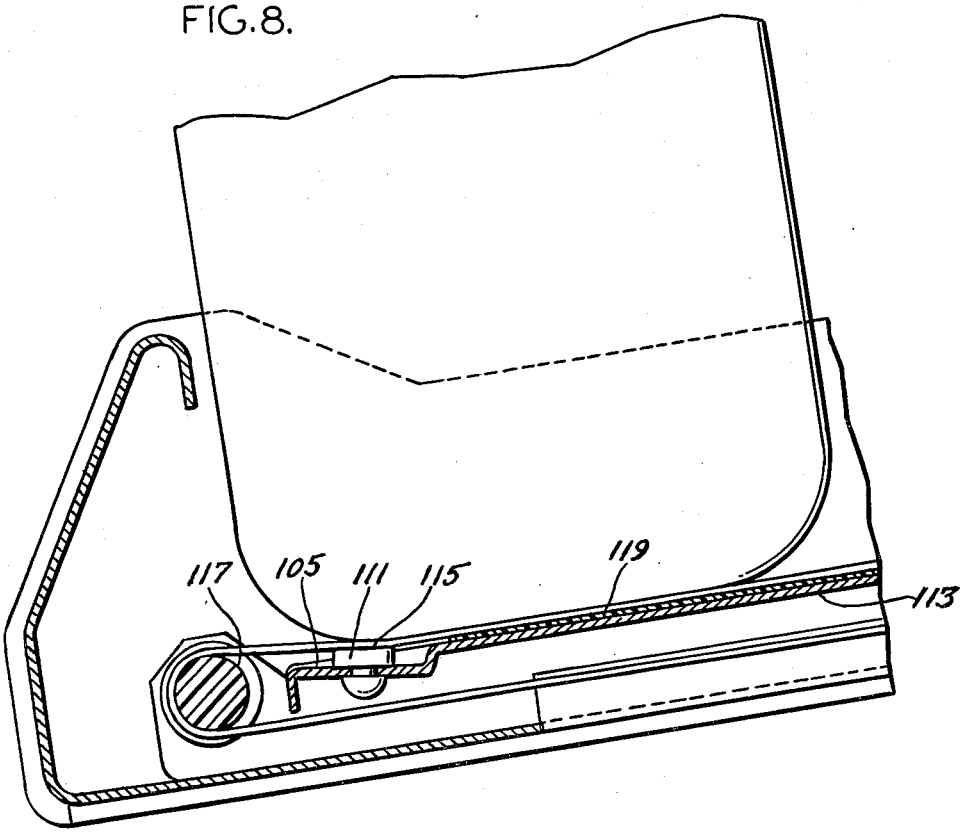
FIG. 8 is a vertical section illustrating the operation of the track of FIG. 7.

FIGS. 7 and 8 illustrate a modified version of the apparatus of FIGS. 5 and 6, in which the recess 105 and brake pads 107, 109 and 111 are tilted with respect to conveyor support surface 113. As best shown in FIG. 8, the upper surface 115 of brake pad 111 is in a plane tangent to roller 117. Since the top of roller 117 is above the supporting surface constituted by PTFE strips 119 and 121, pad surface 115 is canted with respect to these surfaces. The lower ends of the brake pads are substantially aligned with PTFE surface 119 and 121, and the upper ends are raised relative to these surfaces. The canting of the brake pads is most effectively accomplished by forming the recess in such a way that its upper surface is tilted. The canted brake pads of FIGS. 7 and 8 are effective in producing the desired retardation of belt movement while accommodating a wide variety of bottle sizes and weights.

The multiple pad configuration of FIGS. 5 and 7 is especially effective in producing a gradual stoppage of the belt in that the center pad is the first one to act when a bottle approaches the brake pad location. The center pad acts to retard the movement of the belt, and the belt is ultimately brought to a stop when the bottle is positioned so that it pushes the belt downwardly against the outer pads of the three-pad configuration.

Figure 9:
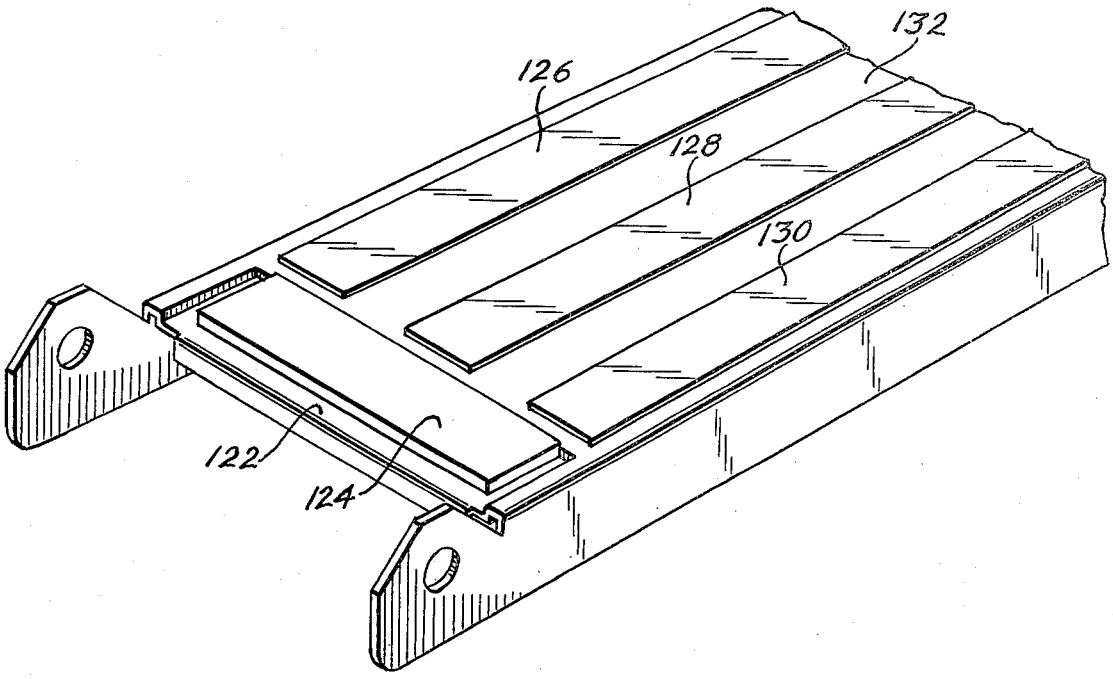
FIG. 9 is a fragmentary perspective showing the forward end of a track in accordance with a third embodiment of the invention.
Figure 10:
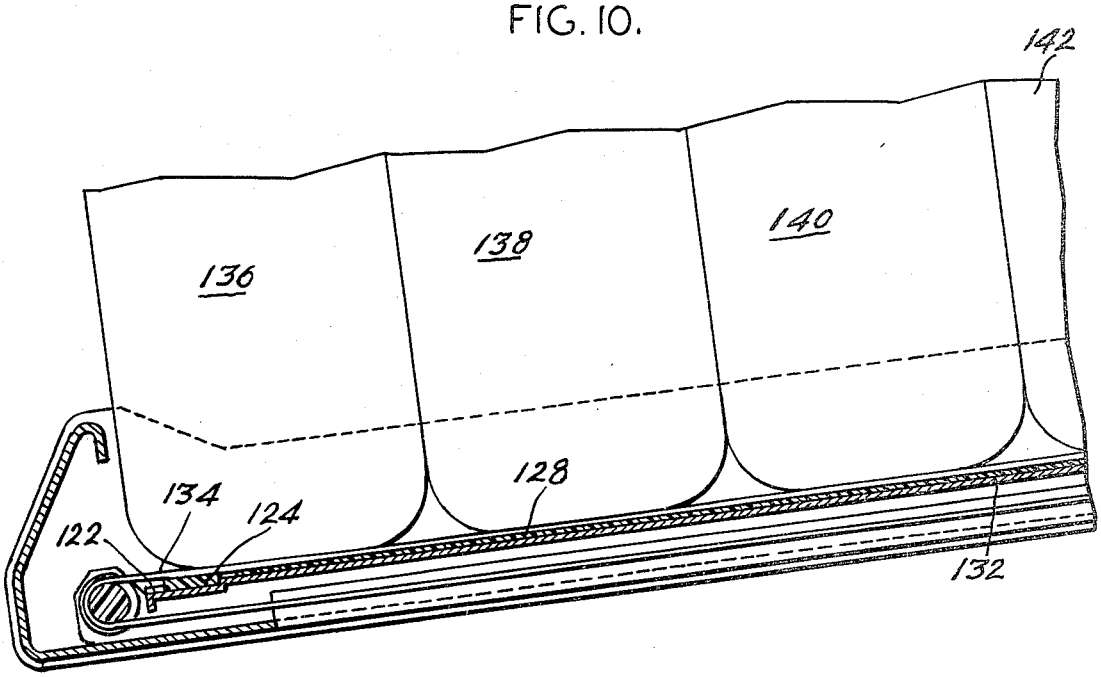
FIG. 10 is a vertical section illustrating the operation of the track of FIG. 9.

The track assembly of FIGS. 9 and 10 is provided at its forward end with a recess 122 in which is secured a rectangular rubber pad 124, which is elongated in the direction transverse to the direction of conveyor movement. PTFE strips 126, 128 and 130 are arranged lengthwise along web 132. The depth of recess 122 is related to the thickness of pad 124 in such a way that the upper surface of pad 124 is substantially flush with the upper surfaces of the PTFE strips. Typically, the depth of the recess below the surface of web 132 is 0.91 mm., and the thickness of pad 124 is 1.57 mm., so that the frictional surface of the pad is slightly above the web by a distance of about 0.66 mm. The result is that the frictional surface of the pad is located slightly above the surfaces of the PTFE strips, and is able to exert a highly effective retarding action on conveyor belt 134, as shown in FIG. 10.

The principal advantage of the elongated rubber strip 124 is that its thickness can be carefully controlled, and therefore its vertical position relative to the PTFE strips can be accurately controlled in the production of the track assemblies for consistent stoppage of the column of bottles 136, 138, 140 and 142 at the position illustrated in FIG. 10.

From the foregoing, it will be apparent that the frictional pad retarders underlying the conveyor belt near the forward edge thereof provides an effective and highly advantageous means for halting the movement of a column of bottles in an automatic, forward-feed shelf, particularly in that it substantially eliminates the possibility of damage to the bottles or their labels by eliminating the need for a bumper, and by bringing the column of bottles to a gradual stop. The incorporation of the brake means in forward-feed conveyor shelving is accomplished inexpensively, and is applicable to spring and motor-driven forward-feed conveyor shelving as well as to gravity-driven shelving.

Modifications, of course, can be made to the exact retarder configurations described herein. For example, the number of retarding pads and their configuration can be varied, and materials other than rubber can be used.

Another significant advantage arising out of the use of frictional pad retarders to stop the forward movement of the columns of bottles is that it eliminates the need for bumper rails, which require either a larger vertical spacing between shelves or a very steep tilt angle for access to the bottles by customers. Consequently, with the use of frictional pad retarders, a given number of shelves can be positioned within a narrower vertical range. This facilitates customer access to the displayed bottles and allows a reduction in height and weight in the support.

What is claimed is:

1. In a shelf having a flexible conveyor belt for supporting a plurality of articles arranged in a column and automatically feeding the articles in said column forward in a columnwise direction when the foremost article in the column is removed, at least one frictional pad located at a position underneath said conveyor belt and responsive to the presence of an article on said belt and above said position, for stopping the movement of said belt, and substantially rigid support means underlying said conveyor belt, the upper surface of said support means and the underside of said conveyor belt having a mutual coefficient of friction permitting sliding of the conveyor belt on said support means, said support means also having a recess in its upper surface, and said pad being located in said recess and having a frictional surface substantially flush with said upper surface and adapted to retard the movement of the belt by frictional engagement with the underside of the belt in response to the weight of an article located on said belt above said pad, whereby said column of articles is stopped with the foremost article located above said position.

2. In a gravity-feed shelf having an endless flexible conveyor belt supporting a plurality of articles arranged in a column and automatically feeding the articles in said column forward in a columnwise direction when the foremost article in the column is removed, at least one frictional pad located at a position underneath said conveyor belt and responsive to the presence of an article on said belt and above said position, for stopping the movement of said belt, and substantially rigid support means underlying said conveyor belt, the upper surface of said support means and the underside of said conveyor belt having a mutual coefficient of friction permitting sliding of the conveyor belt on said support means, said support means also having a recess in its upper surface, and said pad being located in said recess and having a frictional surface substantially flush with said upper surface and adapted to retard the movement of the belt by frictional engagement with the underside of the belt in response to the weight of an article located on said belt above said pad whereby said column of articles is stopped with the foremost article located above said position.

3. A shelf having the capability of supporting a plurality of articles arranged in a column and automatically feeding the articles in said column forward in a columnwise direction when the foremost article in the column is removed, said shelf comprising an endless flexible conveyor belt arranged in a loop and being movable in a closed path substantially defined by said loop; substantially rigid support means located within said loop, said support means having an upper surface, a section of said belt being located above and resting on said upper surface of said support means, and another section of said belt extending underneath said support means; the upper surface of said support means and the section of said belt resting thereon sloping in the direction of belt movement, and the upper surface of said support means and the surface of said belt toward the interior of said loop having a sufficiently low mutual coefficient of friction to allow movement of said belt in said loop in response to the action of gravity on an article carried on the section of the belt resting on the upper surface of the support means; and at least one frictional pad located at a position within said loop near the lower end of said upper surface of said support means and responsive to the presence of an article on said belt and above said position, for stopping the movement of said belt, in which said support means is provided with a recess near its lower end and in which said pad is located in said recess, said pad having a frictional surface substantially flush with said upper surface of said support means and adapted to retard the movement of the belt by frictional engagement with the underside of the belt in response to the weight of an article located on said belt above said pad, whereby said column of articles is stopped with the foremost article located above said position.

4. A shelf according to claim 3 in which said frictional surface is elongated in the direction transverse to the direction of belt movement.

5. A shelf having the capability of supporting a plurality of articles arranged in a column and automatically feeding the articles in said column forward in a columnwise direction when the foremost article in the column is removed, said shelf comprising an endless flexible conveyor belt arranged in a loop and being movable in a closed path substantially defined by said loop; substantially rigid support means located within said loop, said support means having an upper surface, a section of said belt being located above and resting on said upper surface of said support means, and another section of said belt extending underneath said support means; the upper surface of said support means and the section of said belt resting thereon sloping in the direction of belt movement, and the upper surface of said support means and the surface of said belt toward the interior of said loop having a sufficiently low mutual coefficient of friction to allow movement of said belt in said loop in response to the action of gravity on an article carried on the section of the belt resting on the upper surface of the support means; and at least one frictional pad located at a position within said loop near the lower end of said upper surface of said support means and responsive to the presence of an article on said belt and above said position, for stopping the movement of said belt and having roller means located at the lower end of said support means, said conveyor belt passing over said roller means and the surface of said roller means extending above the lower end of the upper surface of said support means, in which said pad has a frictional surface adapted to retard the movement of the belt by frictional engagement with the underside of the belt in response to the weight of an article located on said belt above said pad, whereby said column of articles is stopped with the foremost article located above said position, said frictional surface sloping upwardly from said upper surface of said support means in the direction of belt movement, and being substantially in a plane tangent to said roller means.

6. A shelf according to claim 5 in which said support means is provided with a recess near its lower end and in which said pad is located in said recess.

* * * * *